US006557279B2

(12) United States Patent
Araki et al.

(10) Patent No.: US 6,557,279 B2
(45) Date of Patent: May 6, 2003

(54) VARIABLE IMAGE-DISPLAYING MEMBER

(75) Inventors: Yoshinori Araki, Sagae (JP); Takiguchi Shigeyuki, Tendo (JP)

(73) Assignee: 3M Innovative Properties Company, St. Paul, MN (US)

( * ) Notice: Subject to any disclaimer, the term of this patent is extended or adjusted under 35 U.S.C. 154(b) by 21 days.

(21) Appl. No.: 09/870,183

(22) Filed: May 30, 2001

(65) Prior Publication Data

US 2002/0002783 A1 Jan. 10, 2002

(30) Foreign Application Priority Data

Jun. 5, 2000 (JP) ..... 2000-167001

(51) Int. Cl.[7] ..... G09F 3/04
(52) U.S. Cl. ..... 40/447; 40/582; 345/84
(58) Field of Search ..... 40/447, 452, 582, 40/583; 345/84; 340/815.62

(56) References Cited

U.S. PATENT DOCUMENTS

| | | | | |
|---|---|---|---|---|
| 3,648,281 A | | 3/1972 | Dahms et al. | |
| 4,163,332 A | * | 8/1979 | Salam | 340/815.44 |
| 4,318,098 A | | 3/1982 | McGreevy | |
| 4,893,903 A | * | 1/1990 | Thakar et al. | 340/908.1 |
| 4,983,956 A | | 1/1991 | Salam | |
| 5,050,327 A | | 9/1991 | Woltman | |
| 5,148,156 A | | 9/1992 | Huber et al. | |
| 5,500,652 A | | 3/1996 | Huber et al. | |
| 5,563,621 A | * | 10/1996 | Silsby | 345/43 |
| 5,638,084 A | * | 6/1997 | Kalt | 345/31 |
| 5,781,333 A | * | 7/1998 | Lanzillotta et al. | 359/290 |
| 5,790,088 A | | 8/1998 | Johnson et al. | |
| 5,818,640 A | | 10/1998 | Watanabe et al. | |

FOREIGN PATENT DOCUMENTS

| | | |
|---|---|---|
| EP | 0 466 097 A2 | 1/1992 |
| GB | 2 045 991 A | 11/1990 |
| WO | WO 97/39436 | 10/1997 |

* cited by examiner

*Primary Examiner*—William L. Miller
(74) *Attorney, Agent, or Firm*—James V. Lilly

(57) ABSTRACT

A variable image-display having an opaque substrate having a front surface which is observed by an observer, and a back surface opposing the front surface, and a plurality of pixel elements which are arranged on the front surface of the substrate in rows and columns. Each pixel element comprises a fixed part having the first fixed face which is fixed to the front surface of the substrate, the second fixed face adjacent to the first fixed surface, and a border line between the first fixed face and the second fixed face. An opaque shutter which is rotatable around an axis is in parallel with the border line between the fixed faces such that in a first static state, the second fixed face of the fixed part and the second observable face of the shutter are juxtaposed to form a first visible pixel, in a second static state, the first fixed surface of the fixed part and the first observable face of the shutter are juxtaposed to form a second visible pixel. The static states of the pixel elements can be determined independently of each other or synchronously with each other, thereby variable imaged may be displayed.

16 Claims, 5 Drawing Sheets

VARIABLE IMAGE-DISPLAYING MEMBER

FIELD OF THE INVENTION

The present invention relates to a variable image-display that displays variable images comprised of visible pixels.

BACKGROUND

A sign having a static image comprising a retroreflective sheet is disclosed in, for example, U.S. Pat. No. 5,050,327. The image of this sign is formed from a light-transmitting prismatic retroreflective sheet. The prismatic retroreflective sheet comprises a prismatic sheet having prism elements that are called cube comer prisms that can reflect light in a specific direction by the effective use of a refraction function and a total reflection function of the prism elements. In addition, the prismatic sheet is made of a light-transmissive polymeric material, and thus the sheet as a whole allows light to transmit therethrough. Accordingly, the retroreflective sheet effectively reflects the illumination light entering the surface of the prismatic sheet, and allows the sign image to be brightly observed by an observer. On the other hand, the light entering the back surface of the prismatic sheet can transmit through the sheet and thus the prismatic sheet allows the sign image to be brightly observed by an observer.

In addition to reflective sheets that increase the visibility in a relatively narrow observation angle range, wide observation angle type reflective sheets that increase the visibility in a wide observation angle range are used. As a sign-illuminating system that uses a sign having an image comprising a wide observation angle type reflective sheet, Japanese Patent No. 2,910,868 (corresponding to U.S. Pat. No. 5,818,640) discloses an external illumination type sign-illuminating system comprising a sign and an external light source. In this system, the light source is arranged so that it emits light that enters the sign surface at an incident angle in the range between 0 degree and 30 degrees. In general, a retroreflective sheet having a sign image thereon is adhered to the sign surface. The reflective sheet, that is improved to have a wide observation angle range, comprises optical refractive elements such as glass beads, prism elements, etc., and reflection elements such as deposited metal films, etc. In the case of the above described cube comer prism elements, the light can be reflected in a specific direction using the total reflection function of the prisms without reflection elements.

Furthermore, signs are known, that can display variable images comprised of a plurality of light-emitting pixels. Such image-displays commonly have the following components:

(A) a substrate having a front surface which is observed by an observer, and a back surface opposing said front surface, and (B) a plurality of pixel elements that are arranged on the front surface of the substrate in rows and columns, (i.e. perpendicular to the row directions).

Each pixel element has an internal light source as an essential component. Well known examples of such variable image-displays include electronic signs, and the like. An electronic sign-type image-display is disclosed in, for example, WO97/39436. The variable image-display uses pixel elements comprising light-emitting panels that have one or more light-emitting elements such as an LED as the internal light sources.

In the case of such a variable image-display an observable image is created by a plurality of light-emitting pixels. The background that functions to contrast the image, clear, are composed of comprises pixels that do not emit light. The image can be varied by controlling the light emission from the pixels with the aid of a computer so that pixels at certain positions on the front surface of the substrate are allowed to emit light while other pixels are not.

However, the above-described variable image-displays may not display images, if a part or all of the light-emitting elements cannot emit light because of failure of the light-emitting elements or electronic control circuits.

Therefore, it has been proposed to include the above-described reflective members comprising prismatic sheets (prismatic sheet reflectors) in parts corresponding to the light-emitting panels. The variable image-display is improved so that an image can be observed by reflecting light from an external light source at a high luminance with the reflectors on the surfaces of the light-emitting parts, even if the light-emitting elements do not emit light.

In the case of such a type of a variable image-display a light-transmitting reflector comprising a prismatic sheet is provided on the surface of the light-emitting parts, and thus the light from the light-emitting elements illuminates the light-emitting part from its backside. The light illuminated from the backside of the prismatic sheet passes through the prismatic sheet, and allows the image to be brightly observed by the observer. Accordingly, this type of variable image-display can function in the same way as the above-described electronic sign-type variable image-display when the internal light sources thereof (e.g. light-emitting elements) emit light.

Such a variable image-display has a structure shown in FIG. 6. In the variable image-display (9), each pixel element comprises (i) a fixed part having a light-emitting part (93) formed on the front face of the substrate (90), an adjacent area (94) that is adjacent to the light-emitting part, and a border line (96) formed between the light-emitting part and the adjacent area, and (ii) an opaque shutter (91) that is rotatably fixed to a respective axis in parallel with the border line (96), and is movable between a first static state to shield light-emitting part(s) (93), and a second static state to expose the light-emitting part(s) (93), the shutter having a second face (912) facing an observer in a first static state and a first face (911) facing the. observer in a second static state.

In the second static state, the light-emitting part (93) and the first face (911) of the shutter are observed while being arranged parallel with each other on the front face of the substrate form a visible pixel. In this state, the light-emitting part emits light. In general, prismatic sheet reflectors having the same color are arranged on the light-emitting part (93) and the first face (911) of the shutter.

In the first static state, the light emitting-part (93) is shielded. Thus, the light-emitting part (93) and the first face (911) of the shutter cannot be observed, even when they are externally illuminated. The second face (912) of the shutter and the adjacent area (94) that faces the observer in the first static state, are generally colored black. Thus, they can effectively form the non-light-emitting pixel as a background, that functions to contrast the image formed with the visible (i.e. light emitting) pixels. Accordingly, the image can be varied by controlling the states of the pixels so that some pixel elements (shutters) are in the second state and the corresponding light-emitting parts (93) are allowed to emit light, while the rest of the pixel elements are in the first state. The static states of the pixel elements are determined independently of each other.

In general, the light-emitting part (93) consists of (1) an opening (e.g. hole) provided in the substrate and a prismatic sheet reflector provided to cover the entire opening, or (2) a light-emitting-reflection module which is detachably provided in an opening provided in the substrate.

A variable image-display having the light-emitting parts of structure (1) is disclosed in, for example, U.S. Pat. No. 5,050,327; while one having the light-emitting parts of structure (2) is disclosed in, for example, U.S. Pat. Nos. 5,148,156, 5,500,652 and 5,790,088. The light-emitting-reflection structure (2) comprises a small-sized light-emitting device such as an LED, and a prismatic sheet reflector. Thus, in the case of failure of the light-emitting device, the module of each light-emitting part is replaced. To facilitate the exchange of the module, the light-emitting-reflection modules are detachably mounted in the respective openings. In the case of structure (1), at least one internal light source (e.g. a fluorescent lamp, etc.) is provided on the backside of the substrate to illuminate the back surfaces of the prismatic sheet reflectors through the openings. In either structure, a plurality of openings are required to form the plurality of light-emitting parts.

The conventional variable image-displays having shutters are advantageous for the production of signs displaying simple words or sentences, but are not suitable for the production of image-display or devices to display variable signs that can change from one static image to another static image. Such variable-displays or devices are being used in place of conventional road signs or directional signs carrying printed static images. The reason for this will be explained with reference to FIG. 6.

In the case of the conventional signs carrying printed static images, the backgrounds are typically a relatively bright color (e.g. red, yellow, blue, green, etc.). However, in the conventional variable image-display, the adjacent areas (94) and the second faces (912) of the shutters (91) are colored black. If they were colored a bright color, the difference of brightness between the non-light-emitting pixels and the light-emitting pixels would be too large. This would result in the sign having a different appearance in comparison with conventional printed static signs.

It is advantageous for images comprised of a plurality of visible pixels to be substantially continuously seen, to display relatively complicated designs or marks or characters (e.g. having a relatively large number of strokes such as Chinese characters) and to be similar in appearance to conventional printed static image signs. To this end, the size (width) of the frame (95) between the adjacent openings should be made as small as possible so that the image can be seen continuously. However, the reduction of the width of the frame (95) will decrease the mechanical strength of the frame (95) itself, and in turn, the mechanical strength of the substrate (90) having a plurality of such frames (i.e. with a narrow width). To increase the mechanical strength of the substrate, the thickness of the substrate may be increased, or a material having a larger density is used to produce the substrate. However, the increase of the thickness of the substrate, or the use of the material having a larger density make it difficult to decrease the thickness of the display or to reduce the weight of the display.

For example, some road signs have image-display planes with a relatively large area (e.g. 1 $m^2$ or larger). To maintain the compatibility (i.e. in size) with such a large static image sign, a variable image-display having an image-displaying plane with a relatively large area would be produced. The conventional variable image-display includes the weight of the light-emitting units, the light source(s), and the space in which the light-emitting units are mounted, making it difficult to reduce the weight and thickness of the display as a whole while maintaining the size of the display area.

SUMMARY

The present invention discloses a variable image-display, that can form a variable image sign similar to a conventional signs carrying a printed static image. The variable-image display advantageously has a similar apperance to a conventional printed static image, is amenable to a reduced weight or reduced thickness display as a whole, and allows the image comprising a plurality of visible pixels to be seen continuously.

With the variable image-display of the present invention, the images can be illuminated with an external light source and observed. Thus, it is not necessary for the variable image-display to have a light source that allows the pixels to emit light. The pixels can be observed brightly (at a high luminance) with an external light source, since the pixels have reflective surfaces. Accordingly, the variable image-display of the present invention can be suitably used as a sign such as a road sign and a directional sign, or a component of such a sign.

The present invention relates to an improvement of a variable image-display in which each pixel element comprises (a) two fixed faces on the front surface of a substrate, and (b) an opaque shutter, which is rotatable between two static states, wherein, in one static state, the shutter shields one of the fixed faces so that it becomes unobservable allowing the other fixed face to be exposed so that it is observable. Either the fixed face surface or the back surface of the shutter is observable in each static state. In such image-display, the pixel elements are changed between two static states, and form visible pixels in each static state. Thus, the image comprised of such visible pixels can be changed to display a plurality of images.

In one aspect, the present invention provides a variable image-display comprising an opaque substrate having a front surface that is observable, and a back surface opposing said front surface, and a plurality of pixel elements that are arranged on said front surface of the substrate in rows and columns (i.e. that are perpendicular to the row directions). Each pixel element comprises a fixed part having a first face that is fixed to said front surface of the substrate, and a second fixed face adjacent to said first fixed surface, and a border line between said first fixed face and said second fixed face, and an opaque shutter having a first and second observable face which is rotatable around an axis and parallel with said border line between said fixed faces. In a first static state, said second fixed face of the fixed part and said second observable face of the shutter are juxtaposed each other to form a first visible pixel. In a second static state, said first fixed surface of the fixed part and said first observable face of the shutter are juxtaposed each other to form a second visible pixel. The static states of each pixel element can be determined independently of each other or synchronously with each other. Thereby an image comprised of a plurality of the visible pixels is displayed. The first and second fixed faces consist of a reflective surface of a substantially opaque reflective member that covers said front surface of the substrate and the first and second observable faces consist of a reflective surface of a substantially opaque reflective member that covers the surface and back surface of said shutter. The image may be illuminated with an external light source (e.g. car headlight) when observed.

In the variable image-display of the present invention, the two fixed faces (the first and second fixed faces) on the front surface of the substrate, and the surface and back surface (the first and second observable faces) of the shutter consist of respective reflective surfaces of substantially opaque reflective members. The image comprised of such visible pixels is illuminated with an external light source, and can be observed at a high luminance. Accordingly, it is not necessary to form openings (through holes) in the substrate and utilize the transmitted light from the backside of the substrate in order to increase the visibility of the visible pixels. Thus, the above problem is solved, and the sign carrying the variable sign that is similar in appearance to a conventional sign carrying a printed static image can be obtained.

The reflective member used in the present disclosure is usually a reflective sheet such as a retroreflective sheet. Thus, the reflective surface can be easily formed by the adhesion of the reflective sheet to the component such as the substrate.

DETAILED DESCRIPTION

Figure 1:
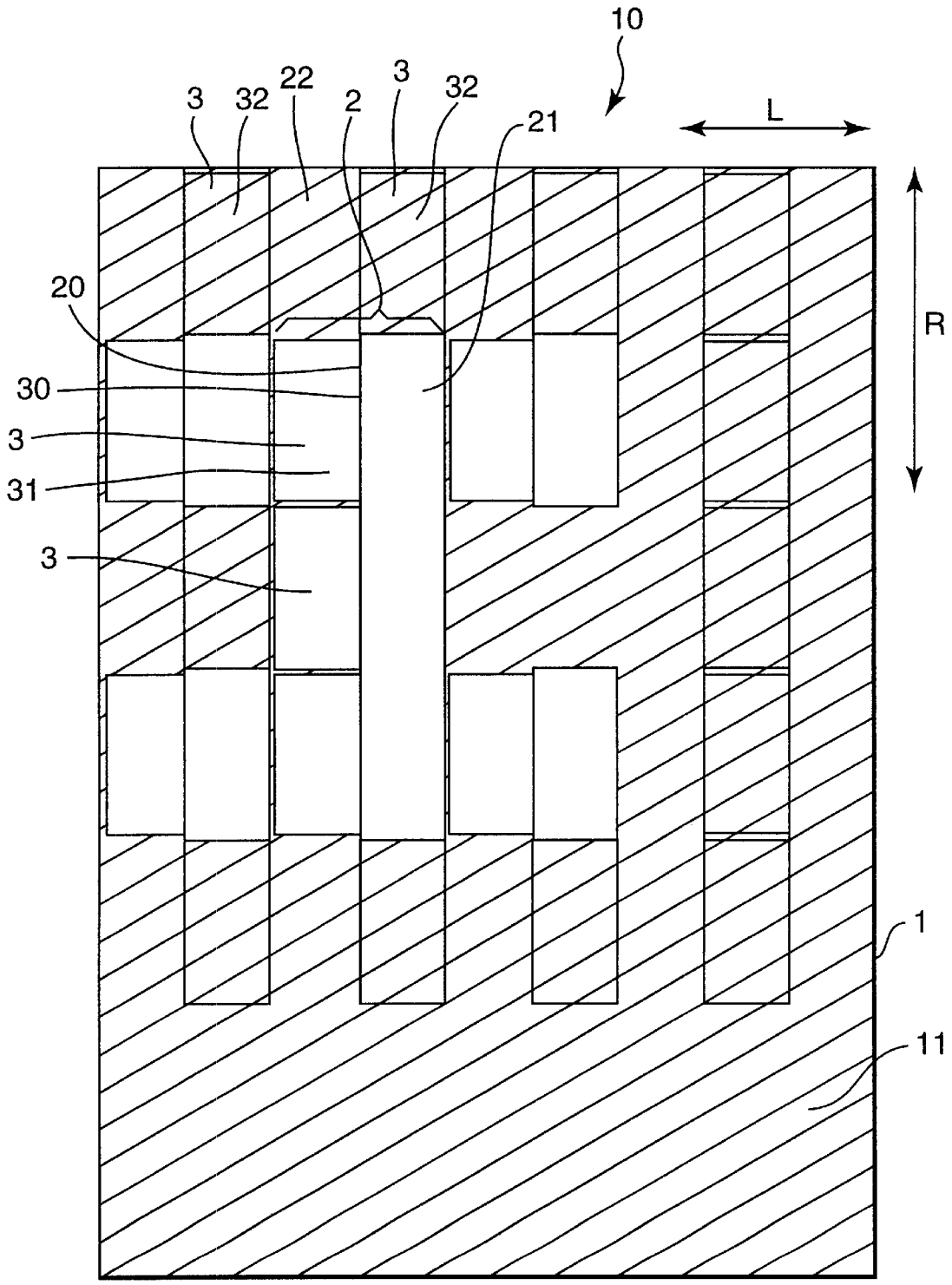
FIG. 1 is a plan view of one example of the variable image-display of the present invention.

One preferable example of the variable image-displaying member of the present invention will be explained by making reference to FIGS. 1 and 2.

The shown variable image-display (10) comprises (A) an opaque substrate (1) having front surface (11) that is observed by an observer, and a back surface (12) opposing the front surface (11), and (B) a plurality of pixel elements (3) that are arranged on the front surface (11) of the substrate in rows (i.e. direction (L)) and columns (i.e. direction (R). The substrate (1) has no holes or openings through the substrate at the location wherein the pixel element(s) (3) are provided.

Each pixel element (3) comprises a fixed part (2), that is fixed to the front surface of the substrate having a first fixed face (21) and a second fixed face (22) beneath shutter (3) adjacent to the first fixed face in the row direction (L) of the front surface of the substrate. The fixed part (2) comprises two different reflective members that are arranged adjacently to each other and cover the front surface (11) of the substrate, and the reflective surfaces of the reflective members constitute the first fixed face (21) and the second fixed face (22), respectively. In addition, a border line (20) is formed between the first fixed face (21) and the second fixed face (22).

Figure 2A:
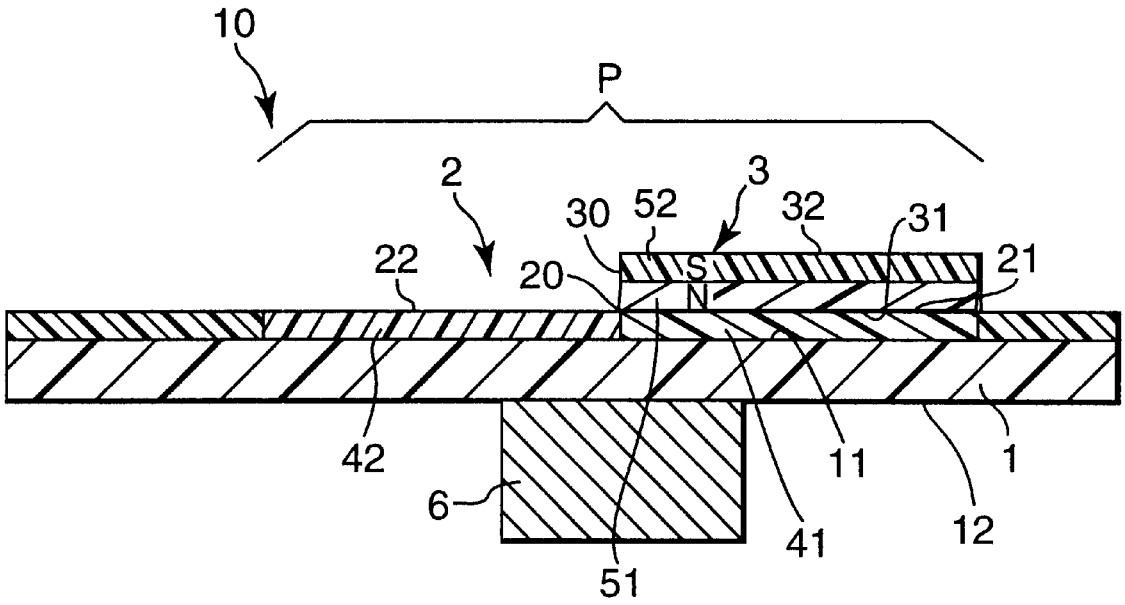
FIGS. 2*a* and 2*b* are cross sectional views of one example of the variable image-display of the present invention in two static states.
Figure 2B:
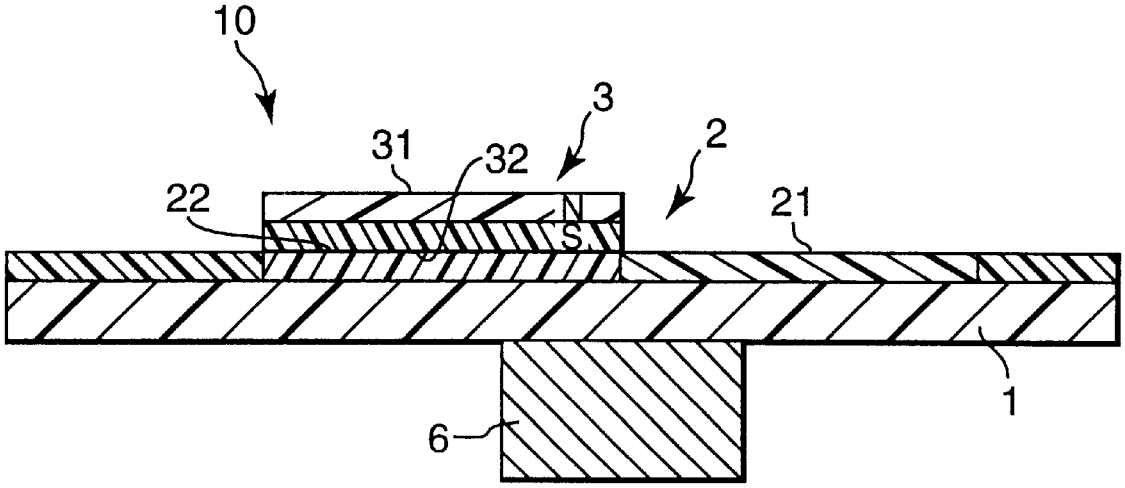

In the examples of FIGS. 1 and 2, each fixed part (2) consists of a first reflective sheet (41) having a white reflective surface and a second reflective sheet (42) having a colored reflective surface, that are fixed to the front surface (11) of the substrate with an adhesive (not shown). That is, the first fixed face (21) consists of the reflective surface of the first reflective sheet (41), while the second fixed face (22) consists of the reflective surface of the second reflective sheet (42).

A typical reflective sheet has a white reflective surface. Thus, a reflective sheet having a colored reflective surface may be produced by providing a transparent color ink layer or a transparent colored film on the reflective surface of the white reflective sheet.

In addition to the fixed parts (2), each pixel element has the opaque shutter (3). The shutter (3) has two main surfaces (a surface and a back surface) having a geometrical shape. The shape of the main surface of the shutter maybe a triangle, a rectangle, a semicircle, a semi-ellipse, etc. In the shown example, the main surface of the shutter has an oblong plane form (i.e. rectangular).

The shutter (3) is rotatably fixed around an axis (not shown) in parallel with the column direction (R) of the front surface of the substrate, that is, in parallel with the border line (20). For example, a rotation axis is fixed to the front surface (11) of the substrate in parallel with border line (20), and the shutter (3) is rotatably fixed to the axis. In this case, shutter (3) has a bearing having a bore to receive the rotation axis at or near one edge part (30) corresponding to the longer side of the rectangle of the main surface.

The rotation axis may be fixed to the shutter (3). In this case, a bearing member is fixed to the front surface (11) of the substrate along the border line (20), and the rotation axis of the shutter is received in the bearing member to rotatably fix the shutter (3) to the front surface of the substrate. The rotation axis in this case comprises a pair of axes fixed to the side surfaces of the rectangle of the main surface of the shutter corresponding to the two shorter sides, so that the axes extend in the direction perpendicular to the rotation direction of the shutter near the edge part (30).

The bearing member in the example is colored with the same color as that of one of the fixed faces, or made of a colorless transparent plastic. In the latter case, the bearing member may be molded integrally with the colorless transparent plastic sheet or plate that covers the entire fixed surface of the substrate and may be used as a covering sheet or plate to protect the fixed surface.

The shutter (3) performs as follows through the interaction of the electromagnet (6) attached to the back surface (12) and a permanent magnet built in the shutter (only the polarities being shown in FIG. 2), the details of the performance of the shutter subsequently described.

The shutter (3) rotates in the row direction (L) between the first static state (FIG. 2(*a*)) in which the shutter shields the first fixed face (21) of the fixed part (2) so that the first fixed face (21) is not observed, and the second static state (FIG. 2(*b*)) in which the shutter shields the second fixed face (22) so that the second fixed face (22) is not observed.

The rotation axis may be arranged in parallel with the row direction (L). In this case, the border line between the two fixed faces is in parallel with the row direction (L), and the shutter rotates in the column direction (R).

Furthermore, the rotation axis may incline from the row direction or the column direction. In this case, the border line between the two fixed faces inclines like the rotation axis, and the plane shape of the shutter is preferably a triangle. That is, the shutter is preferably rotated around an axis which is in parallel with the diagonal line of the square pixel.

The shutter (3) has a second observable face (32) observed by the observer in the first static state, and the first observable face (31 ) observed by the observer in a second static state. In the shown example, one main surface of the shutter is the first observable face (31), and the other main surface is the second observable face (32). For example, the shutter (3) comprises the first reflective sheet (51) having a white reflective surface, and the second reflective sheet (52) having a colored reflective surface, that is adhered to the non-reflective surface of the first reflective sheet (51). That is, the first observable face (31) is the reflective surface of the first reflective sheet (51), and the second observable face (32) is the reflective surface of the second reflective sheet (52). The second reflective surface of the second reflective sheet (52) of the shutter (3) is colored with the same color as that of the second fixed face. Alternatively, the shutter (3) may comprise a sheet-form support, the first reflective sheet (51) adhered to one main surface of the support, and the second reflective sheet (52) adhered to the other main surface of the support.

In the first static state, the second fixed face (22) of the fixed part (2) and the second observable face (32) of the shutter (3), are observed while they are juxtaposed each other on the front surface (11) of the substrate, and form the first colored visible pixel. On the other hand, in the second static state, the first fixed face (21) of the fixed part (2) and the first observable face (31) of the shutter (3) are observed while they are juxtaposed each other on the front surface (11) of the substrate, and form the second white visible pixel.

The static states of the pixel elements (3) can be determined independently of each other or synchronously with each other, like a conventional variable image-display. Thereby, the display can display images comprising a plurality of visible pixels. The static states of the pixel elements (3) may be controlled by the methods disclosed in U.S. Pat. Nos. 5,148,156 and 5,500,652, 5,790,088, etc.

Unlike the conventional display, in the variable image-display of the present invention, the first and second fixed faces (21) and (22) consist of reflective surfaces of opaque reflective sheets (41) and (42), respectively, and also the first and second observable faces (31) and (32) of the shutter (3) consist of the reflective surfaces of opaque reflective sheets (51) and (52), respectively. Thus, the image composed of a plurality of the visible pixels can be observed at a high luminance, when it is illuminated with the external light source.

The reflective sheets (41, 42, 51, 52) may be retroreflective sheets (including wide observation angle reflective sheets). The reflective sheets preferably has an observation angle characteristic (A), that is defined as follows:

Observation angle characteristic (A):

A reflection luminance measured according to JIS Z 9117 being in the range between 0.2 and 100 cd/lux/m$^2$ at an incident angle of 0 degree and an observation angle of 10 to 20 degrees.

When the reflection luminance is less than 0.2 cd/lux/m$^2$, the visibility of the image may deteriorate at night. When the reflection luminance exceeds 100 cd/lux/m$^2$, the legibility of the information in the image such as characters may deteriorate, and the appearance of the image may differ between night and daytime. Furthermore, the reflection luminance at an incident angle of 0 degree and an observation angle of less than 10 degrees, for example, 4 degrees is usually at least 0.2 cd/lux/m$^2$, preferably at least 1 cd/lux/m$^2$, and more preferably 10 to 500 cd/lux/m$^2$. The displaying member is preferably illuminated with a light source at the illuminance on the image surface (plane surface illuminance) of 10 to 400 lux.

Specific examples of the retroreflective sheets include those commercially available from 3M Company, St. Paul, Minn. under the trade designations "DIAMOND GRADE" Nos. "3963", "3990", "3983", "3924", "3951", "3970", "3971" and "981"; reflective sheets commercially available from Sumitomo 3M, JAPAN under the tradedesignations "HV 8100", "HIGH INTENSITY GRADE 3870" and "ENGINEER GRADE 3290"; and reflective sheets commercially available from Nippon Carbide Industries Co., Ltd. Under the trade designation "CRYSTAL GRADE SERIES".

In the example of FIG. 1, the first fixed face (21) and the second fixed face (22) are continuous in the column direction (R) in parallel with the front surface (11) of the substrate. Thus, it becomes very easy for the image comprised of the visible pixels to be continuously seen. When the fixed faces are continuous in the direction parallel with the rotation axis (the border line between the two fixed fates), one visible pixel in the first static state consists of (1) one observable face of the shutter, and (2) a part of the fixed face adjacent to this observable face. For example, when the size of the shutter in the row direction is 30 mm, in a state where the shutter stands still with one observable face being opened, the visible pixel is comprised of (1) this opened observable face of the shutter, (for example, the first observable face), and (2) a part of the fixed face (for example, the first fixed face) of the fixed surface adjacent to this observable face, which part has the size of 30 mm in the row direction.

The visible pixel is usually formed of a reflective face that is substantially a square. The length of one side of the square is usually 50 mm or less. To smoothen the contour of the image composed of the plurality of the visible pixels, for example, an image including characters having a relatively large number of strokes such as Chinese characters, the length of one side of the visible pixel is preferably 20 mm or less. When the length of one side is too small, the movement of the shutters and its control may become difficult. Thus, the length of one side of the visible pixel is preferably at least 5 mm.

The distance between the adjacent shutters is preferably small, since the composed image is easily seen continuously. If the size accuracy of the shutters themselves, or the positioning accuracy of the shutters fixed to the substrate has an error, the movement of the shutters may be obstructed. Accordingly, the distance between the adjacent shutters is usually from 0.5 to 5 mm, preferably from 0.8 to 3 mm.

As described above, to move the shutter, the interaction of the electromagnet placed on the back surface of the substrate and the permanent magnet built in the shutter can be utilized. The electromagnet placed on the back surface of the substrate comprises a coil consisted of a conductor wound in a plurality of turns. In addition, a core such as an iron core may be placed in the coil. The movement of the shutter to change one static state to the other will be explained in detail by making reference to FIG. 2.

In the first static state (FIG. 2(*a*)), the shutter (3) rests on the substrate (1) with the N pole of the magnet facing the front surface of the substrate, with the second observable face (32) facing outside. When an electric current is supplied to the electromagnet so that the pole of the electromagnet (6) close to the back surface of the substrate becomes the N pole, the N pole of the shutter and the electromagnet repel each other, and thus the shutter (3) rotates. After the rotation, the S pole of the shutter (3) is attracted by the N pole of the electromagnet (6) close to the back surface of the substrate, and thus the shutter (3) rests in the second static state (FIG.

2(*b*)) with the first observable face (31) facing outside. In this state, the electric current supplied to the electromagnet (6) may be shut down. In this state, the magnetic line of force from the magnet in the shutter passes through the coil (not shown) of the electromagnet (6). Thus, the coil and the magnet in the shutter can attract each other with a sufficient force for maintaining the static state, although the attracting force is weak. When the reverse procedure of the above is performed, the position of the shutter can be changed from the second static state to the first static state.

When such movement of the shutter is carried out in the pixel elements independently of each other or synchronously with each other, the visible pixels are changed and, in turn, the image is changed.

The permanent magnet of the shutter is not limited, insofar as the shutter can move as described above. For example, a permanent magnet made of a magnetic material such as ferrites (e.g. barium ferrite, etc.), alnico, rare earth element-cobalt (e.g. samarium-cobalt, etc.), rare earth element-ion-boron (e.g. neodymium-iron-boron, etc.), and the like. These magnetic materials have relatively high magnetic properties (e.g. a residual magnetic flux density, a coercive force, a maximum energy product, etc.), and can form a permanent magnet having as small plane sizes and thickness as possible. Thus, the shutter for the pixel element can be produced without unnecessarily increasing the thickness and weight of the shutter.

The permanent magnet for the shutter can be mounted in the shutter when the shutter is produced. For example, the magnet can be embedded in the support, or the support may be made of a plastic magnet. Alternatively, the magnet is built in the shutter support. In general, such a shutter support has (1) a support part for the shutter member, that has a substantially rectangular surface, and (2) a permanent magnet mounted in the support part. To mount the magnet in the support part of the shutter member, (i) the support part is made of a permanent magnet such as a plastic magnet, or (ii) a permanent magnet is fixed to the surface of the support part.

The shutter may be produced by adhering two reflective sheets with their non-reflective surfaces facing each other to form a reflective sheet laminate, and cutting the laminate in a desired shape and plane sizes. The shutter and the support part for the shutter member are fixed with the back surface of the support part facing one of the reflective surface of the shutter member. Thus, the surface of the support part for the support member is colored with the same color as that of one of the reflective surface of the shutter member (the surface of the reflective sheet). Alternatively, the support part for the shutter member may be formed of a reflective sheet like the shutter. Furthermore, the support part for the shutter member may be formed of a colorless transparent plastic. In the case of the colorless transparent support part, the support part may cover the whole reflective surface of the shutter member.

Since the variable image-display of the present invention does not have any internal light source, only a relatively small electric current necessary to move the shutters is supplied to the displaying member. Thus, the consumed electricity is minimal, and it is possible to function the display with the combination of a solar cell and a storage battery. A solar cell or a condensing unit connected to the solar cell is placed on the surface of the sign, and electric power necessary to move the shutters is optically generated using the light of the external light source that illuminates the sign surface.

EXAMPLES

Example 1

In this Example, a variable traffic sign displaying "NO ENTRY EXCEPT INDICATED DIRECTION(S)" was produced as follows:

As a substrate, an aluminum disc having a diameter of 900 mm and a thickness of 1.5 mm was provided. This substrate was used as a substrate of a conventional sign having a printed static image.

Separately, a reflector was provided to form the fixed part. This reflector was a retroreflective sheet commercially available from 3M under the trade designation "DIAMOND GRADE No. 3990 (White)".

With reference to FIG. 1, the first fixed faces (21) and the second fixed faces (22) were formed on the white reflective surface of the reflective sheet by silk screen printing. The printing was carried out with a transparent blue ink using a silk screen printing plate such that the parts corresponding to the first fixed faces (21) and the circular peripheral part around the substrate disc were made impermeable to the ink. Thereby, the second fixed faces (22) were formed of the surface of the blueprinted layers, and (2) the fixed parts (21) consisted of the unprinted parts of the white reflective sheet.

The blueprinted layers of the fixed parts consisted of stripes each having a width (a size in the row direction) of 17 mm, that continuously extended in the column direction, while the unprinted parts consisted of stripes having a width (a size in the row direction) of 15 mm, that continuously extended in the column direction. The blue and white stripes (each 28 stripes) were formed so that the blue stripes and the white strips were alternately arranged. Then, the reflective sheet having the fixed faces was adhered to one of the main surface of the aluminum disc with an adhesive.

Separately, the shutter (3) were produced. Firstly, a shutter member was produced as follows:

The above reflective sheet sold under the trade designation "DIAMOND GRADE No. 3990 (White)" was provided. The reflective surface of another reflective sheet of "DIAMOND GRADE No. 3990" was solidly printed with the above transparent blue ink. Then, the two reflective sheets were adhered with their non-reflective surfaces facing each other to form a laminate. This laminate was cut in the form of a rectangle of 15 mm×30 mm to obtain a shutter member consisting of the laminate of the two reflective sheets.

Next, the above shutter member was fixed to a shutter support to obtain the shutter (3) used in this Example. The shutter support had (i) a support part for a shutter member, which was made of a colorless transparent plastic sheet having a plane size of 15 mm×30 mm, (ii) a permanent magnet (in a disc form having a diameter of about 6 mm and a thickness of about 4 mm) that was fixed at a position at the center of the lengthwise direction and near the one edge in the widthwise direction, and (iii) a pair of rotation axes which were integrally fixed to the respective corners opposing each other along one long side of the rectangle support part and each of which had a length of about 4 mm. The shutter member was adhered to the support part using a transparent adhesive with the back surface of the support part and the blue reflective surface of the shutter member facing each other.

Separately, a plurality of bearing members made of the colorless transparent plastic of the reflective sheet were fixed along the border lines (20) between the two types of the fixed faces. Each bearing member was fixed to the designed position on the border line so that it would receive one rotation axis of the shutter member, a pair of the bearing members rotationally supported one shutter, and the shutter could rotate smoothly.

Subsequently, the shutters (3) were rotatably provided on the respective bearing members to form, on the aluminum substrate, a plurality of pixel elements each of which comprised (a) one shutter (3), and (b) the first and second fixed parts (21, 22) each of which had a size of 30 mm in the lengthwise direction, and which were adjacent to each other through the border line (20) to which the shutter was rotatably fixed. The visible pixel composed of each pixel element was in the form of a substantial square having a side length of about 30 mm, and 584 pixel elements were formed on the substrate.

Finally, a plurality of electromagnets (6) were attached on the back surface (12) of the substrate near the border lines (20) so that one electromagnet corresponded to one pixel element. Thus, the sign consisting of the variable image-display was finished.

Figure 3:
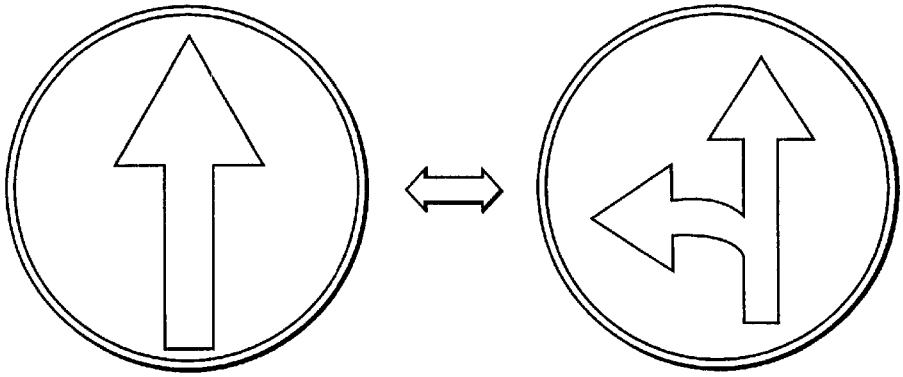
FIG. 3 is a plan view showing two states of the variable sign of Example 1.
Figure 6:
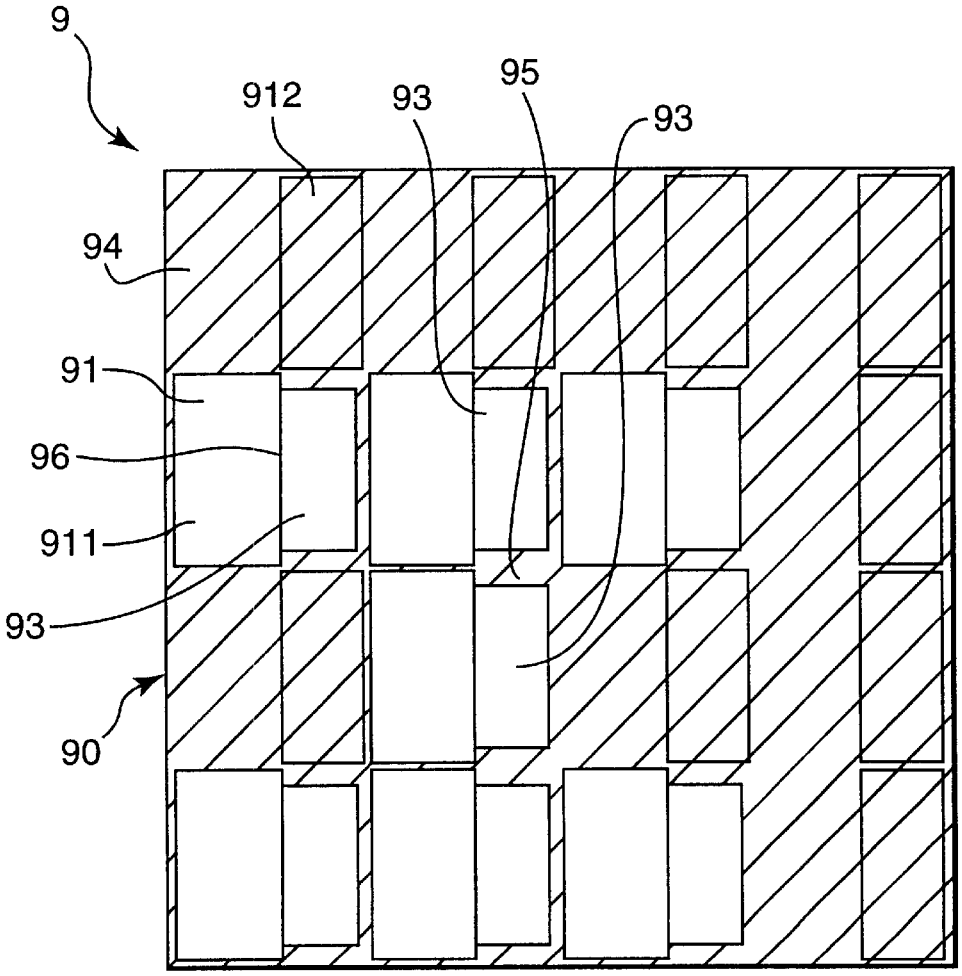
FIG. 6 PRIOR ART
FIG. 6 is a plan view of one example of the variable image-displaying member of the prior art.

This sign was positioned with the column direction (L) being in parallel with the vertical direction, and operated. The images of FIG. 3 were prepared as bit map data, and the ON/OFF and polarities of the electromagnets were controlled by a computer to control the static state of each pixel element. Thus, each image was displayed. The sign image on the left side of FIG. 3 and that on the right side of FIG. 3 were reversibly changed by the control of the operation of the electromagnets.

With each image displayed by the sign of this Example, peripheral edges of the formed image were more or less irregular, when the sign was observed from a short distance, but the number,shapes and directions of arrows in the variable image were recognized in the daytime and at night like the conventional printed static image sign when it was observed from a distance of 10 m or more. At night, the sign was illuminated with a metal halide lamp "M400 L/BH-SC" of Matshushita Electric Industrial Co., Ltd.

With the sign of this Example, the static states of the pixel elements can be controlled independently of each other. Thus, it can display other desired images freely in addition to the above two images, and therefore it is a free-pattern (multi-pattern) type variable sign.

Example 2

Figure 4:
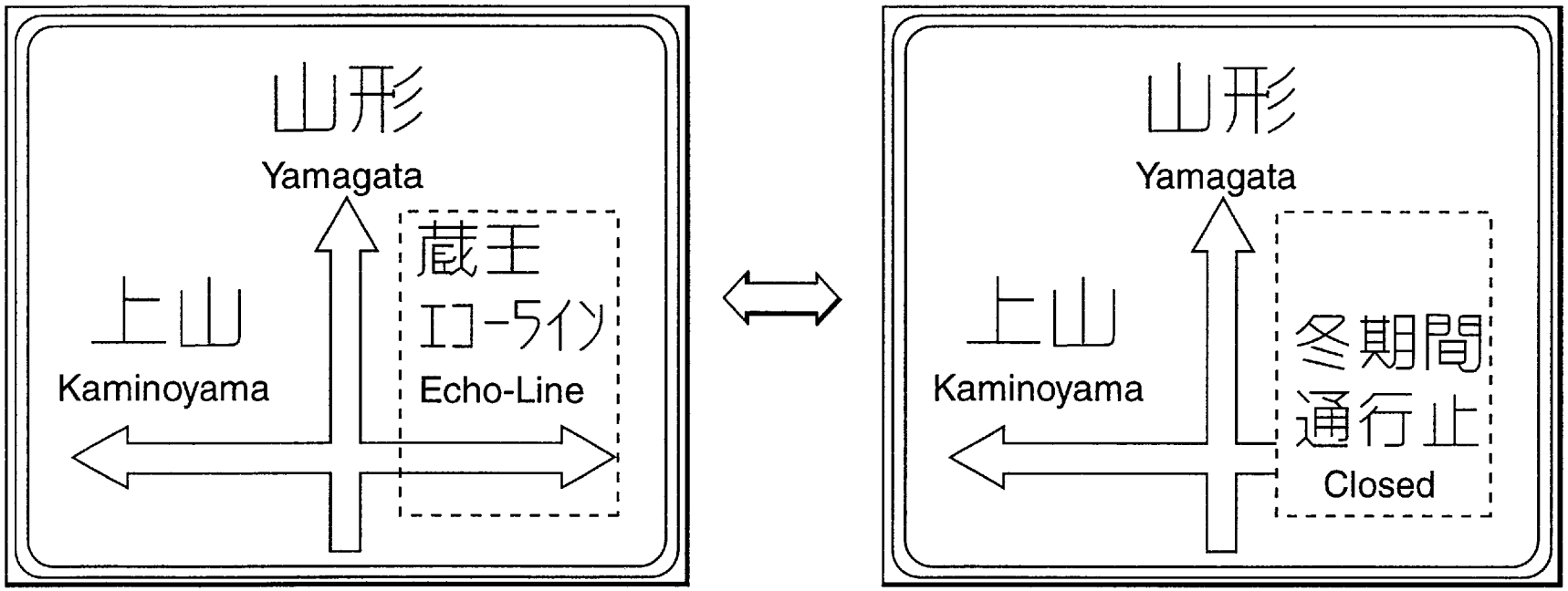
FIG. 4 is a plan view showing two states of the variable sign of Example 2 including the variable image-display as a part.

This Example produced a variable directional sign displaying a partly variable directional sign. This destination sign can variably display several types of destination information, that are different from season to season. The variable sign of this Example was produced in the same manner as that in Example 1 except as follows:

The variable image-display of the present invention was produced as a rectangular module corresponding to an area surrounded by the dotted line of FIG. 4. The non-variable part of the sign of FIG. 4 was produced like in the case of a conventional printed static image sign. That is, the main part of the destination sign was produced by adhering the static image which had been prepared by screen printing the characters and arrows as shown in FIG. 4 on the reflective surface of the above reflective sheet sold under the trade designation "DIAMOND GRADE No. 3990 (White)" using the above transparent blue ink, on the aluminum sign substrate.

In the above module, the visible pixel composed of the pixel element was in the form of a substantial square having a plane size of about 10 mm×about 10 mm (each shutter member being in the form of a substantial rectangle having a plane size of 5 mm×10 mm), since the displayed image included the Chinese characters.

An opening for attaching the above module was formed at the specific area of the main part of the destination sign, and then the module was attached to finish the variable image sign of this Example.

Like the sign of Example 1, the sign image on the left side of FIG. 4 and that on the right side of FIG. 4 were reversibly changed by the control of the operation of the electromagnets.

The peripheral edges of the visible pixels in the images displayed on the sign of this Example were much less irregular than those in Example 1, and the contours of the images were smooth, because the size of the visible pixels was smaller than that of Example 1.

When this image was observed from a distance of about 50 m to 100 m, the characters in the variable image were readable, and the shape and direction of the arrow could be recognized in the daytime and at night, like in the case of a conventional printed static image sign.

With the sign of this Example, the static states of the pixel elements can be controlled independently of each other. Thus, it can display other desired images freely in addition to the above two images, and therefore it is the free-pattern type variable sign.

Example 3

Figure 5:
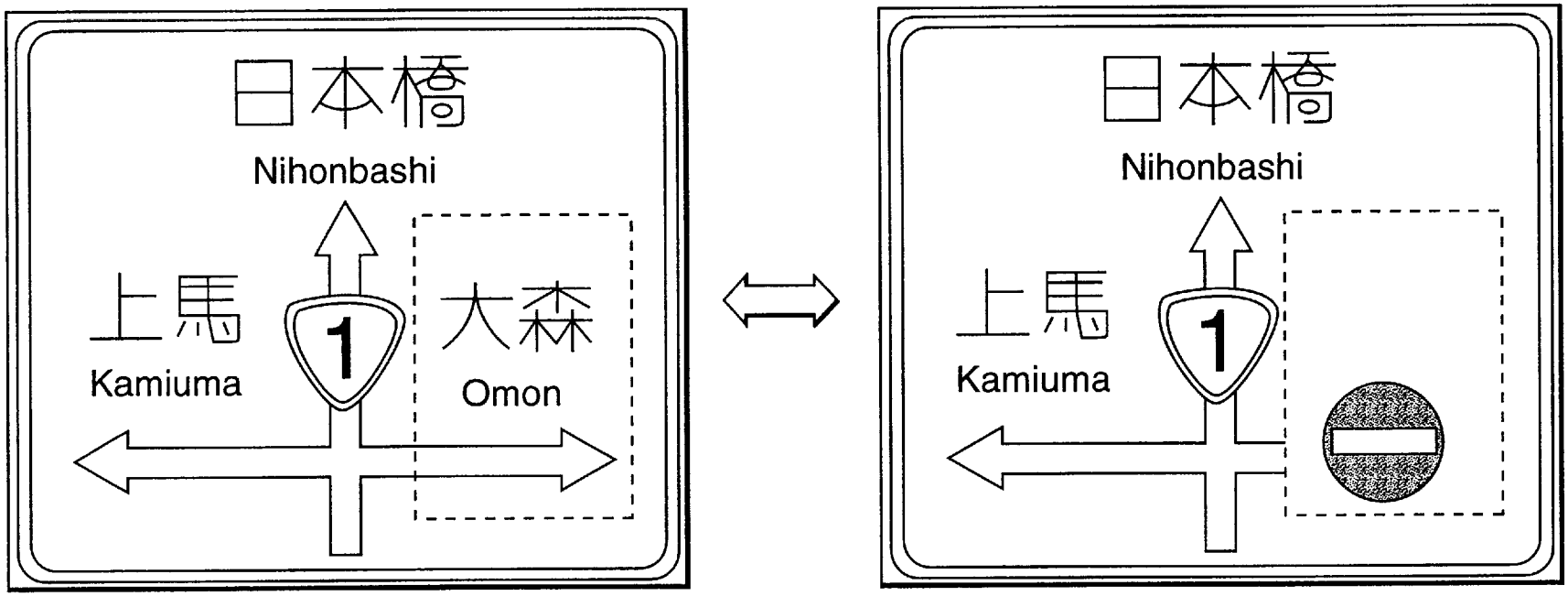
FIG. 5 is a plan view showing two states of the variable ordering sign of Example 3including the variable image-display as a part.

This Example produced another partly variable directional sign that was different from that of Example 2. This destination sign can variably display two different sign images, when the traffic density varies between night and day. The variable sign of this Example was produced in the same manner as that in Example 2 except as follows:

The rectangular module corresponding to an area surrounded by the dotted line of FIG. 5 (the variable image-displaying member) was produced like in the case of Example 2. The non-variable part of the sign of FIG. 5 was produced like in the case of a conventional printed static image sign. The module of this Example was used with synchronizing the static states of the pixel elements.

Firstly, to display the first image including (in Japanese) "Omori" and the right arrow in the first static state in which all the shutters were in the same direction, the second fixed faces of the fixed part and the second observable faces of the shutters were formed as follows:

On the above reflective sheet, i.e., No. 3990 (white), the above first image was printed with the transparent blue ink, and cut to a plurality of pieces-each having the specific area and shape. The cut pieces were suitably allocated to the second observable faces of the shutters and the second fixed faces so that a plurality of visible pixels, which were observed in the first static state, formed the above first image. The second observable face of each shutter was a substantial rectangle of 25 mm×50 mm.

Like in the above case of the second fixed faces of the fixed part and the second observable faces of the shutters, the first fixed faces of the fixed part and the first observable faces of the shutters were formed so that the second image including the circular sign of "NO ENTRY" was displayed. In this case, besides the blue transparent ink, a transparent red ink was also used to form the background of the circular sign.

Then, the assembled module was attached to the main art of the sign to finish the variable image sign of this Example.

When this image was observed from a distance of about 50 m to 100 m, the characters in the variable image were readable, and the shape and direction of the arrow could be recognized in the daytime and at night, like in the case of a conventional printed static image sign.

Example 4

The variable image sign of this Example was produced in the same manner as in Example 2 except that a wide observation angle type reflective sheet sold under the trade designation "HV 8100" (available from Sumitomo 3M) was used as a reflective sheet.

When this sign was illuminated with a flood lamp sold under the designation "OPL-250" (available from Sumitomo 3M) at an illumination angle, of about 20 degrees (with the normal direction to the reflective surface of the sign being 0 degree), the various variable images were brightly observed.

What is claimed is:

1. A variable image-display comprising:

(A) an opaque substrate having a front observable surface and a back surface opposing said front surface, and (B) a plurality of pixel elements arranged on said front surface of the substrate in rows columns, wherein each pixel element comprises a (a) a first fixed face and a second fixed face, adjacent to said first fixed face, the first and second fixed face having a reflective surface, and a border line between said first fixed face and said second fixed face, and (b) an opaque shutter that is rotatable around an axis, that is in parallel with said border line between said fixed faces, said shutter having a first and second observable face each having a reflective surface;

wherein in a first static state, said second fixed face and said second observable face of the shutter are juxtaposed forming a first visible pixel, and in a second static state, said first fixed surface and said first observable face of the shutter are juxtaposed forming a second visible pixel.

2. The variable image-display according to claim 1, wherein said first fixed face and said first observable face are both colored white or a first color, while said second fixed face and said second observable face are both colored with a second color.

3. The variable image-display according to claim 1, wherein the static states of said pixel elements are determined independently of each other to display 3 or more different images.

4. The variable image-display according to claim 1, wherein the static states of said pixel elements are determined synchronously with each other to display a first image comprised of the plurality of visible pixels observed in the first static state and a second image comprised of the plurality of visible pixels observed in the second static state.

5. The variable image-display according to claim 1, wherein said first fixed face and said second fixed face are continuously arranged along said borderline.

6. The variable image-display of claim 1 wherein the observable surfaces are illuminated with an external light source.

7. The variable image-display of claim 1 wherein the substrate is substantially free of openings that utilize transmitted light from the back surface of the substrate in order to increase the visibility of the pixels.

8. The variable image-display of claim 1 wherein the reflective surface comprises reflective sheets.

9. The variable image-display of claim 1 wherein the reflective surface comprises retroreflective sheets.

10. The variable image-display of claim 1 wherein the pixel has a length at a side of 20 mm or less.

11. The variable image-display of claim 1 wherein the pixel has a length at a side at least 5 mm.

12. The variable image-display of claim 1 wherein the back surface of the substrate further comprises an electromagnet.

13. The variable image-display of claim 1 wherein the shutter further comprises a magnet.

14. The variable image display of claim 1 wherein movement of the shutter changes the first static state to another.

15. The variable image-display of claim 1 wherein the display does not have an internal light source.

16. A variable image-display comprising:

(A) a substrate having a front observable surface and a back surface opposing said front surface, and (B) a plurality of pixel elements arranged on said front surface of the substrate in rows columns, wherein each pixel element comprises (a) a first fixed face and a second fixed face, adjacent to said first fixed face, the first and second fixed face having a reflective opaque surface, and a border line between said first fixed face and said second fixed face, and (b) a shutter that is rotatable around an axis, that is in parallel with said border line between said fixed faces, said shutter having a first and second observable face each having a reflective opaque surface;

wherein in a first static state, said second fixed face and said second observable face of the shutter are juxtaposed forming a first visible pixel, and in a second static state, said first fixed surface and said first observable face of the shutter are juxtaposed forming a second visible pixel.

* * * * *

UNITED STATES PATENT AND TRADEMARK OFFICE

CERTIFICATE OF CORRECTION

PATENT NO. : 6,557,279 B2
DATED : May 6, 2003
INVENTOR(S) : Araki, Yoshinori

It is certified that error appears in the above-identified patent and that said Letters Patent is hereby corrected as shown below:

Title page, Item [54] and Column 1, line 1,
Title, delete "IMAGE-DISPLAYING MEMBER" and insert in place thereof
-- IMAGE-DISPLAY --.

Title page,
Item [57], ABSTRACT,
Line 19, delete "imaged" and insert in place thereof -- images --.

Column 1,
Lines 14 and 44, delete "comer" and insert in place thereof -- corner --.

Column 2,
Lines 1 and 2, after "image," delete "clear, are composed of".
Line 44, after "the" delete ".".
Line 49, after "substrate" insert -- to --.
Line 53, delete "light emitting-part" and insert in place thereof -- light-emitting part --.

Column 3,
Line 26, delete "display" and insert in place thereof -- displays --.
Line 64, delete "displaying" and insert in place thereof -- display --.

Column 4,
Line 8, delete "signs" and insert in place thereof -- sign --.
Line 8, delete "variable-image" and insert in place thereof -- variable image --.
Line 9, delete "apperance" and insert in place thereof -- appearance --.
Line 10, after "is" insert -- and --.

Column 5,
Lines 32 and 33, after "variable" delete "ordering".
Line 33, delete "3including" and insert in place thereof -- 3 including --.
Lines 37, 39 and 40, delete "image-displaying member" and insert in place thereof
-- image display --.
Line 48, delete "(R)." and insert in place thereof -- (R)). --

UNITED STATES PATENT AND TRADEMARK OFFICE

CERTIFICATE OF CORRECTION

PATENT NO. : 6,557,279 B2
DATED : May 6, 2003
INVENTOR(S) : Araki, Yoshinori

It is certified that error appears in the above-identified patent and that said Letters Patent is hereby corrected as shown below:

Column 6,
Line 14, delete “maybe” and insert in place thereof -- may be --.

Column 7,
Line 35, delete “and” and insert in place thereof -- , --.
Line 48, delete “has” and insert in place thereof -- have --.

Column 8,
Line 8, delete “tradedesignations” and insert in place thereof -- trade designations --.
Line 10, delete “Under” and insert in place thereof -- under --.
Line 19, delete “fates” and insert in place thereof -- faces --.
Line 52, delete “consisted” and insert in place thereof -- consisting --.

Column 9,
Line 39, delete “sizes” and insert in place thereof -- size --.
Lines 41 and 44, delete “surface” and insert in place thereof -- surfaces --.

Column 10,
Line 27, delete “strips” and insert in place thereof -- stripes --.
Line 29, delete “surface” and insert in place thereof -- surfaces --.
Line 30, delete “were” and insert in place thereof -- was --.

Column 11,
Line 27, delete “number,shapes” and insert in place thereof -- numbers, shapes --.
Line 32, delete “Matshushita” and insert in place thereof -- Matsushita --.

Column 12,
Lines 29 and 30, delete “image-displaying member” and insert in place thereof -- image-display --.
Line 40, delete “white” and insert in place thereof -- White --.
Line 57, delete “art” and insert in place thereof -- part --.

UNITED STATES PATENT AND TRADEMARK OFFICE

CERTIFICATE OF CORRECTION

PATENT NO. : 6,557,279 B2
DATED : May 6, 2003
INVENTOR(S) : Araki, Yoshinori

It is certified that error appears in the above-identified patent and that said Letters Patent is hereby corrected as shown below:

Column 13,
Line 6, after "angle" delete ",".
Line 17, preceding "(a)" delete "a".

Column 14,
Line 15, after "side" insert -- of --.

Signed and Sealed this

Seventh Day of October, 2003

JAMES E. ROGAN
*Director of the United States Patent and Trademark Office*